United States Patent [19]

Harris, Jr.

[11] 4,044,932

[45] Aug. 30, 1977

[54] SMOKING PIPE SLING

[76] Inventor: Ellsworth L. Harris, Jr., 4624 G St., SE., Washington, D.C. 20019

[21] Appl. No.: 623,002

[22] Filed: Oct. 16, 1975

[51] Int. Cl.[2] ..... A45C 11/00

[52] U.S. Cl. ..... 224/26 R; 131/260

[58] Field of Search ..... 224/2 D, 5 R, 2 B, 2 C, 224/2 E, 2 F, 1 R, 26 R, 5 A, 5 C, 5 E, 26 B, 26 K, 21, 17, 13; 131/260; 206/86, 227

[56] References Cited

U.S. PATENT DOCUMENTS

| | | | |
|---|---|---|---|
| 1,605,195 | 11/1926 | Lewis | 224/26 K X |
| 2,387,232 | 10/1945 | Brede | 224/26 K X |
| 2,654,514 | 10/1953 | Jensen | 131/260 UX |
| 3,201,018 | 8/1965 | Moody | 224/26 K |
| 3,977,582 | 8/1976 | McMahon | 224/26 B |

FOREIGN PATENT DOCUMENTS

| | | | |
|---|---|---|---|
| 1,208,702 | 2/1960 | France | 224/2 D |

OTHER PUBLICATIONS

Tandy Leather catalog, p. 86, item No. 14, received Mar. 1975.

*Primary Examiner*—Robert J. Spar
*Assistant Examiner*—Jerold M. Forsberg
*Attorney, Agent, or Firm*—Clarence A. O'Brien; Harvey B. Jacobson

[57] ABSTRACT

A sling for holding a smoking pipe readily accessible on the belt of the user which is flexible, handy, and yet firmly and securely retains a pipe therein.

3 Claims, 4 Drawing Figures

Fig. 1
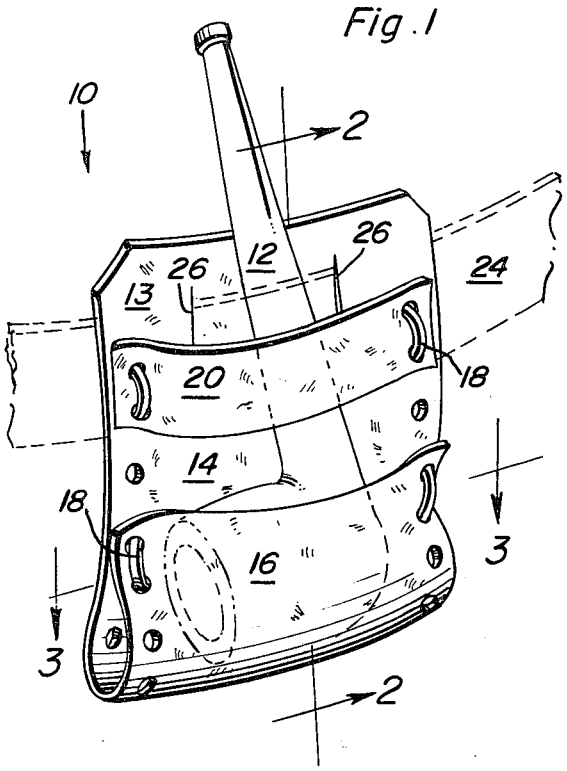
Fig. 2
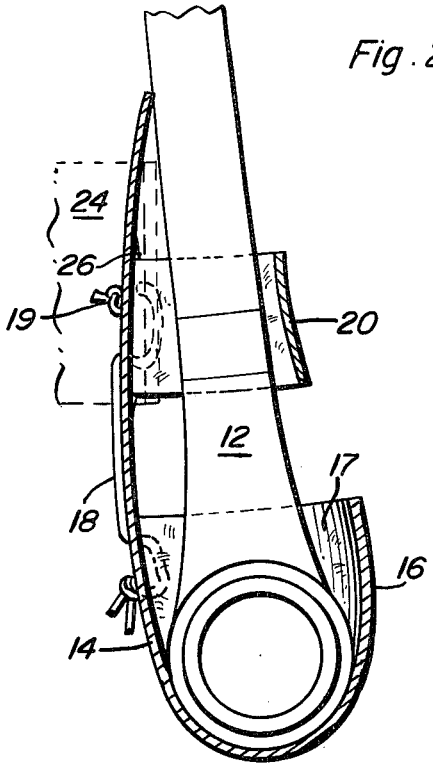
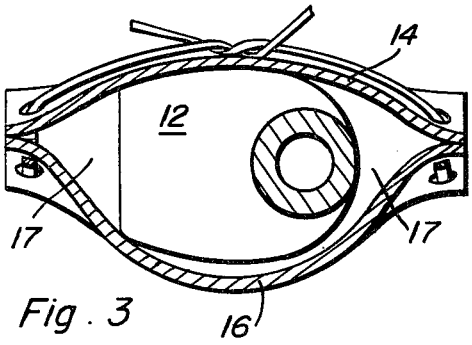
Fig. 3
Fig. 4
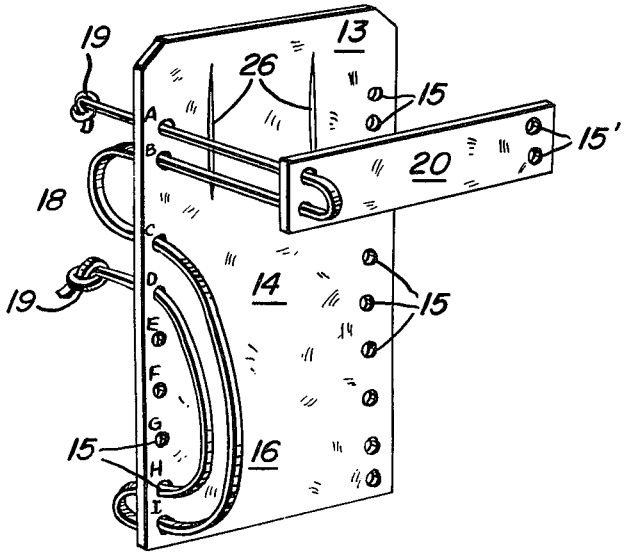

SMOKING PIPE SLING

BACKGROUND OF THE INVENTION

1. Field of the Invention

This invention relates generally to holders for smoking pipes which permit a pipe smoker to carry his pipe with him at all times in a convenient and readily accessible sling worn on his belt.

2. Description of the Prior Art

A common problem for pipe smokers is that there is no convenient place for them to put their pipe when they are not smoking it. Normally a bed or residue of pipe ashes are left in the bowl of the pipe and unless the pipe is supported properly this ash residue will jar out and as anyone who has been around a pipe smoker will readily attest, this can be quite messy. Another problem for pipe smokers is that a typical pocket, either in a jacket or a skirt, cannot really be used to hold a pipe between smokes because of the ash problem mentioned above and also because of the usual shape of pipes with the bowl being normally large and bulky, thus causing distortion of the pockets and an unsightly and unpleasing appearance.

Prior art devices which hold pipes per se are known, but the applicant is not aware of any that provides the features as disclosed by this invention. Reference is made to the patent to Moody, U.S. Pat. No. 3,201,018, patented Aug. 17, 1965, which may be pertinent to this invention.

SUMMARY OF THE INVENTION

An object of the present invention is to provide a sling for a pipe which may be worn on the belt of a pipe smoker for easy access thereto.

Another object of this invention is to provide a sling which is readily assemblable from easy-to-obtain materials and which can be supplied in kit form for assembly by the user.

A further object of this invention is to provide a pouch for securely holding the bowl of a pipe with additional means for retaining the stem of the pipe with the over-all pipe being held in a desired position.

A still further object of this invention is to provide a pipe holder which may be distributed in kit form for assembly by a home craftsman for personal satisfaction and use by himself or as a gift.

One of the big features of this invention is that the basic components are readily assemblable into a practical pipe pouch or sling without any great skill being required for the assembly thereof.

Another important feature is the fact that a pipe is properly held by the sling for convenient accessibility by a pipe smoker. It may easily be mounted on one's belt for convenience and ready availability of the pipe at all times while the smoker is working or playing. One obvious application is use by cab drivers wherein at times they must have both hands free to engage in their driving chores, and yet being an avid pipe smoker, the driver wishes to have his pipe handy at all times. Holders and mounts of the known prior art which can be worn or mounted on the dash of a cab, etc. do not achieve the results of the pouch disclosed by this invention.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the device of this invention.

FIG. 2 is a cross-sectional view taken generally along line 2-2 of FIG. 1.

FIG. 3 is a cross-sectional view taken generally along line 3-3 of FIG. 1.

FIG. 4 is a perspective view of the kit of this invention in a stage of assembly thereof.

DESCRIPTION OF THE PREFERRED EMBODIMENT

Referring to FIG. 1 of the drawing, reference numeral 10 indicates the sling or pouch for holding a pipe as contemplated by this invention. A pipe 12 is shown mounted in the device of this invention which consists of a main body portion 14 having two ends thereon 13 and 16 as best seen in FIG. 4. The end 13 is provided with slots 26 which are of such length as to receive a belt therethrough as shown diagrammatically in FIG. 1. FIG. 1 shows the pipe sling mounted on a belt 24 of a user. Each side edge of the body member 14 is provided with evenly spaced holes 15. A throng or cord 18 is provided for threading through said holes to assemble and hold the pouch in proper position.

As best seen in FIG. 4, an additional member 20 is provided for retaining the stem portion of the pipe in upright position when the bowl of the pipe is mounted in the pouch itself. Assembly and completion of the pouch is quite simple. The leather cord 18 is threaded through proper holes 15 as shown and labeled A through I in FIG. 4. The cord 18 passes through the holes A and B for retention of one side of the support 20 and then through hole C, down through hole I, back through hole H and then through hole D. Appropriate knots 19 are normally provided on the extreme ends of cord 18 to prevent the cord from slipping back through the holes.

As can be readily seen when viewing FIGS. 1 and 4, once a cord 18 is threaded through the right side of the body 14 similarly to the left side as viewed in FIG. 4, by pulling the ends of the cord the pouch itself will be formed and the holder 20 will be secured at each end against the upper portion 13 of the device. So assembled and constructed a pipe bowl supporting pouch 17 is formed between the portions 14 and 16 of the member as best seen in FIG. 2. By using different ones of holes C-I the size of the pouch may be changed. The stem holder 20 will be properly fastened at each end with sufficient slack in the center portion thereof to properly hold the pipe stem in upright position. Once the over-all device is assembled the ends of the cord eighteen-nineteenths may be appropriately tied by any common knot to prevent their loosening and resultant disassembly of the pouch.

While this item can be sold and distributed as a preassembled item for immediate use, it also offers the feature of being packaged, distributed, and sold as an item of construction for home craftsmen, the aged and inform, and young children wishing to make a gift for their father for father's day, as an example. As a kit item the basic kit would include the main member 14 having either the slots 26 and the holes 15 preformed therein, or these areas of the member 14 could be indicated by appropriate indicia printed on said member so that the user and craftsman could make the slits and holes themselves. This would add an additional stage of construction to the project and offer a little more for the craftsman to do. Additional items to the kit would be the member 20 and the cord 18. Again the holes in member 20 could be preformed or could be marked by indicia for completion by the craftsman.

An excellent material for making this pouch or sling from is leather. Whether sold as a finished item or in kit form for completion by an individual craftsman, leather is ideal. Additional tooling and decoration may easily be addded to leather goods in a manner well known in the leather-working art. However, it is obvious that the device can also be made of inexpensive plastic, cloth, or any other strong, yet flexible material.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A sling for holding a pipe readily accessible on the belt of a pipe smoker comprising: a main body member of a single piece of material having two ends, one end having means for attachment to a belt, a pipe stem holding member of rectangular shape and of substantially the same width as the main body member and closely associated with the one end thereof, means for attaching the stem holding member to the one end of the main body member at the edges thereof, the other end of the main body member being bent back upon itself to form a U-shaped pouch for holding the bowl of a pipe, means for holding the edges together of the portion of the member forming the pouch to permit a readily adjustable change in size of the pouch, said means including evenly spaced holes through the edges of the member, a removable cord appropriately interwoven through selected ones of said holes to hold the side edges together before and after adjustment of the pouch, but easily loosened, removed, and rethreaded through other selected ones of said holes to permit said adjustment in the size of the pouch, and knots in the respective ends of the cord to hold the sling together as adjusted and assembled.

2. The device of claim 1 wherein the means for attachment to a belt include vertical slits parallel to each other and of proper length to receive a belt interwoven therethrough.

3. The device of claim 2 wherein the means for attaching the stem holding member includes holes at the edge of said member and the same cord which holds and permits changeable adjustment of the pouch members together interwoven through said holes.

* * * * *